United States Patent [19]

Lizak

[11] 4,063,325

[45] Dec. 20, 1977

[54] SPLASH SHIELD ASSEMBLY FOR PAINT ROLLER

[76] Inventor: John F. Lizak, 920 Clydesdale St., McKeesport, Pa. 15135

[21] Appl. No.: 715,282

[22] Filed: Aug. 18, 1976

Related U.S. Application Data

[63] Continuation-in-part of Ser. No. 617,281, Sept. 29, 1975, abandoned.

[51] Int. Cl.[2] ..... B05C 17/02

[52] U.S. Cl. ..... 15/230.11; 15/248 A

[58] Field of Search ..... 15/27, 230.11, 248 A; 101/328–331; 401/147, 197, 208, 218, 219, 220; 29/110.5

[56] References Cited

U.S. PATENT DOCUMENTS

| | | | |
|---|---|---|---|
| 1,861,179 | 5/1932 | Gray | 15/27 |
| 2,562,482 | 7/1931 | Weisser | 206/361 |
| 2,616,367 | 11/1912 | Sprung | 401/218 R |
| 3,135,006 | 6/1964 | Leland | 401/219 |
| 3,378,872 | 4/1968 | Frontera et al. | 15/248 A X |
| 3,441,355 | 4/1969 | Brown | 401/208 X |
| 3,457,582 | 7/1969 | Fisher | 15/248 A |
| 3,748,683 | 7/1973 | Smith et al. | 15/248 A |
| 3,809,484 | 5/1974 | Bradshaw | 401/208 X |

*Primary Examiner*—Daniel Blum
*Attorney, Agent, or Firm*—Paul Bogdon

[57] ABSTRACT

The assembly includes a support means having a plurality of longitudinally extending, parallel rods or tabs shaped to removably receive a semi-cyclindrical splash shield in spaced relationship to a paint roller. A hub connects the rods or tabs and is rotatably secured to a stub-shaft which is coaxial with the roller shaft. The stub-shaft may be permanently fixed to the handle section of the roller assembly or to a spring clip or the like which is removably secured to the handle section. A screw or the like may be used to secure the hub to the stub-shaft or the roller shaft. The entire shield support means is selectively rotatable so that the shield may be disposed on either side of the paint roller.

16 Claims, 8 Drawing Figures

SPLASH SHIELD ASSEMBLY FOR PAINT ROLLER

This is a continuation-in-part patent application of my copending U.S. patent application, Ser. No. 617,281, filed Sept. 29, 1975, now abandoned.

BACKGROUND OF THE INVENTION

Various splash shield assemblies have been devised for use with paint rollers all of which lack some versatility in their use. Some of the known splash shield designs are limited to a one position relationship to the roller. That is, the shield may not be rotated with respect to the roller whereby it could be on one side of the roller when painting along one edge of a wall and then on the other side of the roller when painting the other edge of the same wall. It is probably because of the inability of certain of the known shield designs to be rotated with respct to the roller that such shields are not to be found on the market.

Some shield designs are permanently arranged on the handle or shaft parts of the roller assembly. Such permancy makes cleaning of the shield difficult. Most shield designs require a complete disassembly of the shield assembly from the roller for cleaning or replacement of the shield. In addition, most of the known shield assemblies are somewhat complex in their arrangements.

The present invention overcomes the above noted problems and drawbacks of existing splash shield designs and provides an assembly which is simple in structure, allows for easy removal and installation of the shield element for purposes of replacement and/or cleaning, and which allows selective rotation of the shield from one side of the roller to the other without the necessity of disassembling or completely replacing the shield assembly. Thus, the present invention is attractive to the market since it is versatile in its use and reasonably inexpensive to manufacture.

SUMMARY OF THE INVENTION

The present invention provides a splash shield assembly for a paint roller having a shaft and a radial handle member rigidly extending generally perpendicular to the shaft from one end thereof, comprising a support means having a plurality of longitudinally extending generally parallel shield receiving members; connecting means for receiving the support means in fixed relationship with the shaft; a shield shaped and sized to extend over a substantial length of the paint roller and to be removably received on the shield members; and the connecting means constructed and arranged for selective rotation about the shaft generally coaxially with the roller axis whereby said shield member may be positioned on either side of the roller.

In one form of the invention the support means for the shield and the connecting means are formed from a single length of rod whereby the connecting means is in the form of a spiral hub sized to snugly, yet rotatably fit on the shaft of the paint roller. The shield receiving members are a pair of parallel rods extending generally longitudinally over the length of the roller axis. The shield has rolled side edges to fit snugly on the rods. In that form of the invention the shield is simply slid on or off of the rods. In another form of the invention the shield receiving members are a plurality of tabs disposed alternately one above the other in a semi-cylindrical pattern. The shield is secured to the support by sticking one of its ends into the tab arrangement.

As to the securing means for holding the shield support in place, in one embodiment of the invention it comprises a machine screw extending through a tapped opening in the spiral hub while in another embodiment it comprises a stubshaft co-axial with the roller shaft and permanently fixed to the handle section of the roller assembly. A wind-nut or the like would hold the shield support to a threaded stub-shaft. In yet another embodiment, the stub-shaft is secured to a spring clip which fits onto the handle section such that the stub-shaft is coaxial with the roller shaft. In either securing means arrangement, the shield may be selectively positioned around the roller merely by unloosening the wing nut and rotating the shield support means.

In still another form of the invention the securing means for holding the shield support in place comprises a clip constructed and arranged to fit on the roller shaft. The clip may be a single piece spring-type clip or a two-piece clip secured by machine screws.

Various other advantages, details and modifications of the present invention will become apparent as the following description of certain present preferred embodiments thereof proceed.

BRIEF DESCRIPTION OF THE DRAWINGS

In the accompanying drawings I have shown certain present preferred embodiments of the present invention in which.

Figures 1, 2, 3, 3A, 4:
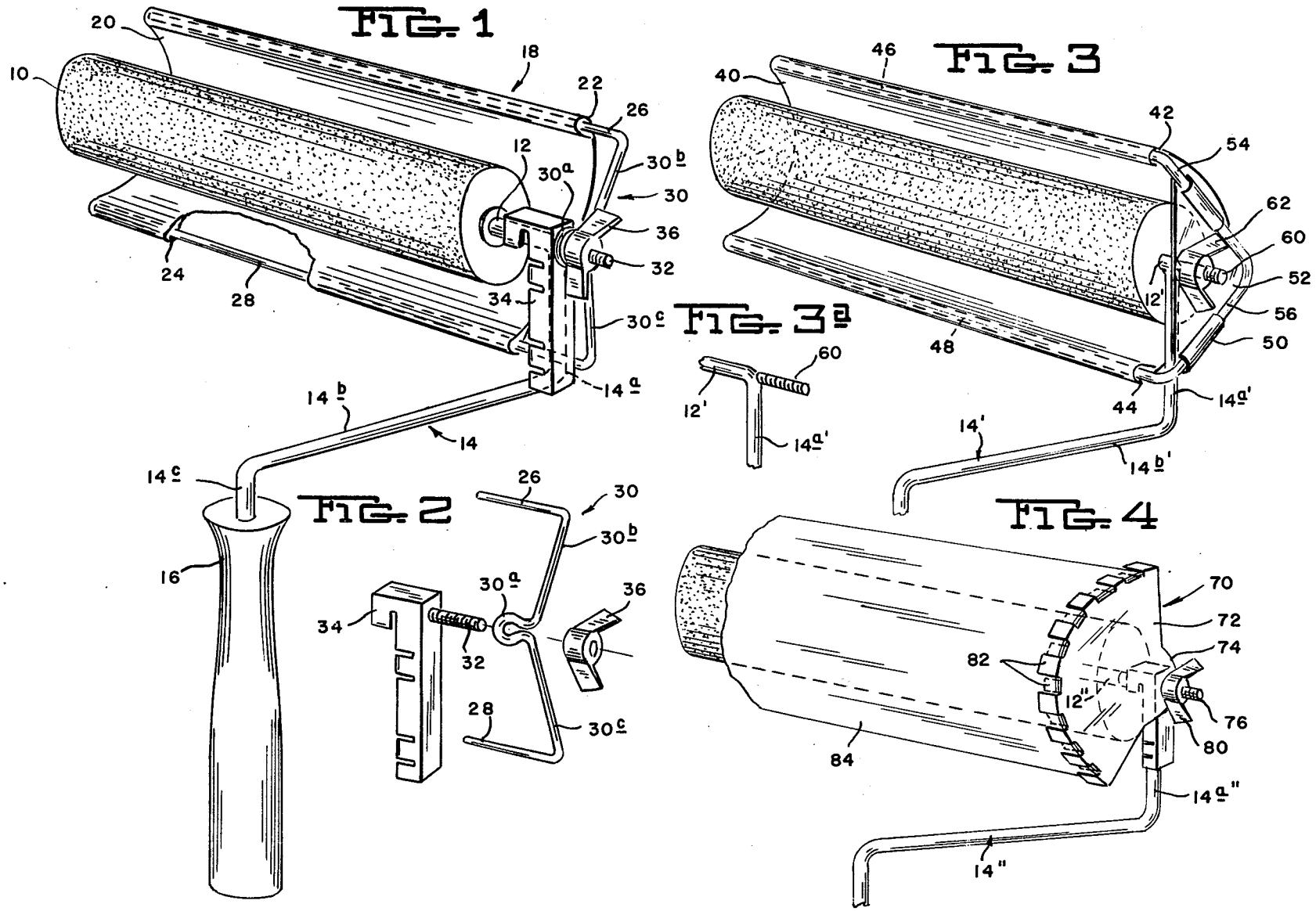
FIG. 1 is a perspective view of one embodiment of the present invention showing the splash shield assembly with a spring clip arrangement for mounting onto a paint roller assembly.
FIG. 2 is a perspective view of the spring clip and part of the shield support with a wing nut all disasssembled from each other.
FIG. 3 is a perspective view of another embodiment of the present invention showing the stub-shaft forming part of the shield support member as being permanently fixed to the handle section of the paint roller assembly.
FIG. 3*a* is a perspective view of part of the handle section of the embodiment of the invention of FIG. 3, clearly showing the stub-shaft as being permanently fixed to the handle section.
FIG. 4 is a perspective view of yet another embodiment of the present invention showing a tab arrangement for holding the shield in place.

As shown, the shield support means has the rods 26 and 28 and hub section 30 formed such that the shield 20 is disposed in a spaced parallel relationship to the paint roller 10 to thereby afford paint splash protection to the user. Orienting the shield 20 on either side of the roller 10 merely requires unscrewing the wing-nut 36 to loosen the shield support and rotating the entire shield assembly around the stub-shaft 32 to position the shield 20. In addition, the shield 20 may be simply removed from or placed on rods 26 and 28 by sliding it on and off the rods.

FIG. 3 shows another embodiment of the present invention and includes a splash shield 40 of the same construction as that of shield 20 of FIG. 1 having rolled longitudinal edges forming slots 42 and 44 which snugly fit onto parallel rods 46 and 48 the ends of which rods are connected to a hub section 50 having a triangular central portion 52 connected with legs 54 and 56 extending to acute angles from the ends of the rods. As also shown in FIG. 3, hub section 50 has rolled edges which serve to connect the central portion 52 with legs 54 and 56. The central portion 52 of hub section 50, has a hole centrally thereof sized to snugly yet rotatably fit onto a threaded stub-shaft 60 which is fixed to the upper portion of section 14*a*′ of handle portion 14′ of the paint roller assembly of FIG. 3. The stub-shaft 60 is generally coaxial with the roller shaft 12′. A wing-nut 62 or the like secures the central portion 52 onto stub-shaft 60. As in the first embodiment, the shield assembly may be rotated simply by unscrewing back the wing-nut 62 to loosen the assembly.

FIG. 4 shows another embodiment of the invention which includes a shield support 70 that may be mounted on either stub-shaft 32 or 60 arrangements of FIG. 1 or 3. The shield support 70 includes a semi-circular main section 72 integrally formed with a hub portion 74 having an opening sized to be snugly received on a threaded stub-shaft 76 shown integrally connected with the upper portion 14*a*″ of handle portion 14″ of the paint roller assembly of FIG. 4. The stub-shaft 76 is generally coaxial with roller shaft 12″. A wing-nut 80 or the like secures the hub portion 74 to the stub-shaft 76. A plurality of uniformly shaped, circumferentially closely spaced tabs 82 are formed on the outer edge of the main section 72 with alternate tabs being disposed one above the other. A semi-cylindrically shaped splash shield 84 is supported by inserting one of its ends as shown in FIG. 4 in between the arrangement of the alternately higher and lower tabs 82. As in the other embodiment, the shield 84 is easily inserted on and removed from the shield support and the entire shield assembly is simply rotated into a desired position by unscrewing the wing-nut 80 to loosen the shield asembly.

Figure 5:
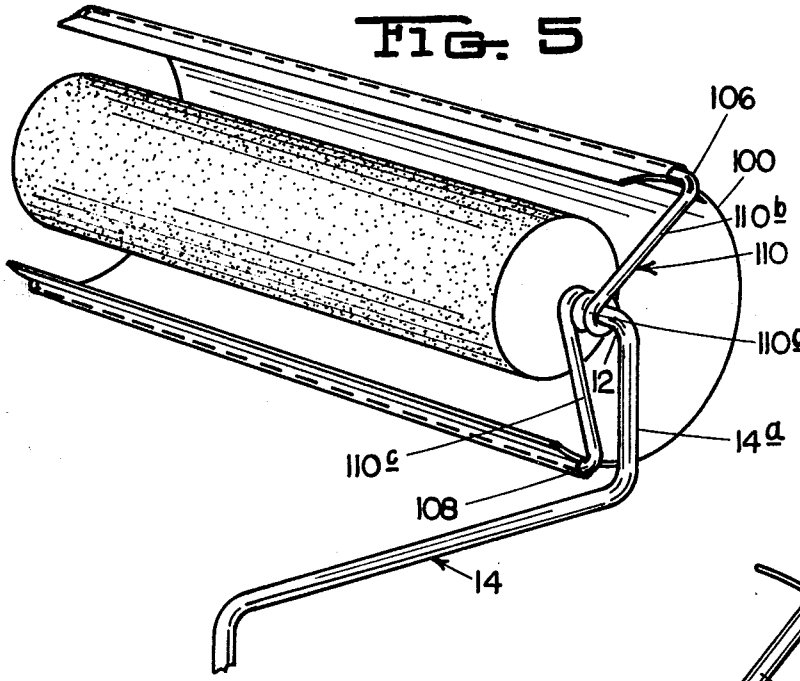
FIG. 5 is a perspective of yet another embodiment of the present invention showing the splash shield assembly with the shield receiving members and the connecting means being integral with each other where the connecting means is a spiral hub fitted on the roller shaft.

FIG. 5 shows yet another embodiment of the present invention and includes a semi-cylindrical splash shield 100 having rolled slots 102 and 104 formed inwardly to the longitudinal edges, which slots snugly fit onto parallel rods 106 and 108, the inner ends of the rods being integrally connected to a hub section 110 formed of a central spiral loop section 110*a* and radially outwardly extending arms 110*b* and *c*. The loop section 110*a* is a spiral defining a generally cylindrical hub sized to be snugly yet selectively rotatably received on the roller shaft 12. As with the previously described embodiment, the shield 100 may be selectively oriented on either side of the paint roller. In the embodiment of FIG. 5, the shield oientation is achieved simply by rotating the entire shield assembly around the roller shaft 12.

Figure 7:
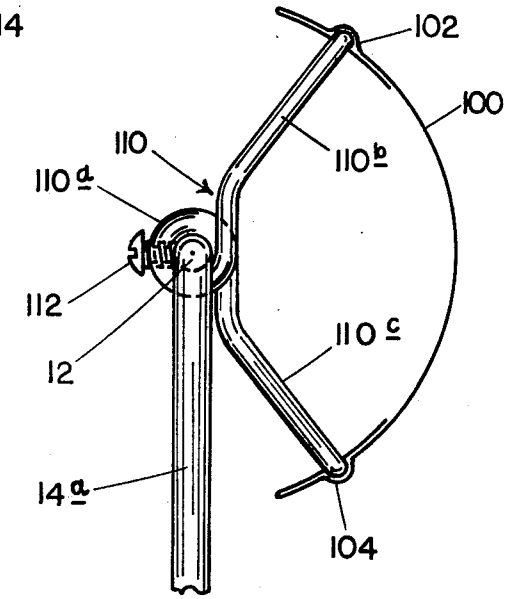
FIG. 7 is an exploded elevation view of the roller portion of the embodiment of FIG. 5 showing in addition to the elements illustrated, a screw member extending radially through the spiral hub and engaging the roller shaft to lock the splash shield assembly in place with the roller shaft; and Referring now to the drawings, there is shown in FIG. 1 one embodiment of the splash shield assembly of the present invention in use with a well-known type paint roller assembly comprising a paint roller 10 mounted for rotation on a shaft 12 which is integrally connected to a radial handle portion 14 having a section 14*a* perpendicular to the roller shaft, another section 14*b* extending downwardly at an acute angle to yet another section 14*c* to which is attached a handle 16. The splash shield assembly 18 includes an elongated semicylindrical shield 20 formed from any suitable material such as a plastic, metal, or paper, having its longitudinal edges rolled to form slots or passageways 22 and 24 which snugly fit onto elongated, generally parallel rods 26 and 28, one end of each being connected to a hub section 30 formed, as clearly shown in FIG. 2, of a central loop section 30*a* and radially extending legs 30*b* and 30*c*. The loop section 30*a* is formed to be snugly yet selectively rotatably received onto a threaded stub-shaft 32 which is fixed to the upper section of an L-shaped spring clip 34 formed to fit snugly onto section 14*a* of the handle portion 14 and an adjacent section of the roller shaft 12 as shown in FIG. 1. The stub-shaft 32 is arranged on the spring clip 34 so that it is generally coaxial with roller shaft 12 when the spring clip is fixed to the roller assembly. A wing-nut 36 or the like secures the loop section 30*a* to the stub-shaft 32.

FIG. 7 shows the elements of FIG. 5 with the addition of a screw 112 extending through a suitably provided tapped opening on side of the spiral loop section 110*a*. The screw 112 is shown having its end engaging the roller shaft 12 to lock or secure the shield assembly in place with the roller shaft.

Figure 6:
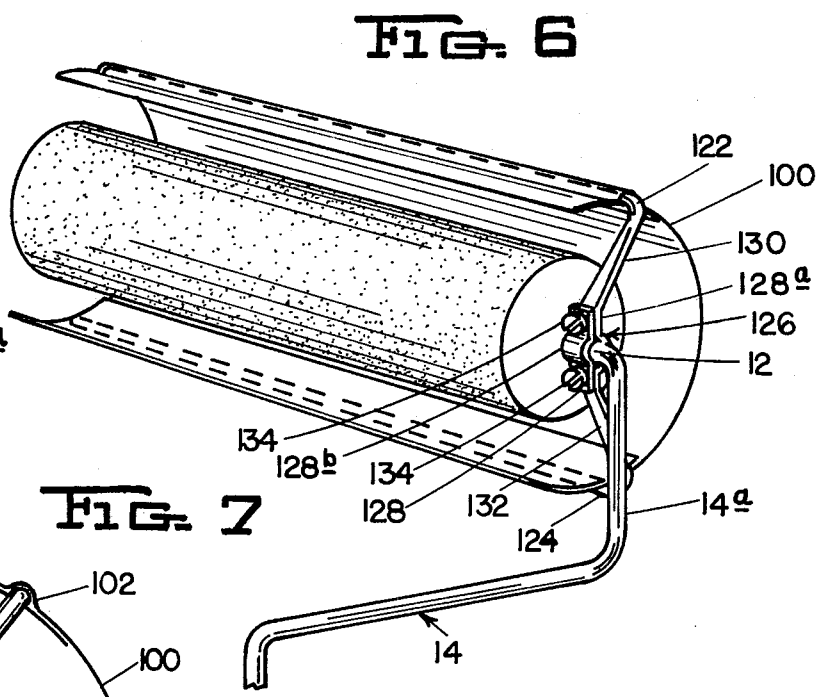
FIG. 6 is a perspective view of still another embodiment of the present invention showing the connecting means of the splash shield assembly as being a clip arrangement secured to the roller shaft.

FIG. 6 shows still another embodiment of the present invention and includes parallel shield receiving rods 122 and 124 integrally connected with a hub section 126 formed of a central clip 128 and radially extending arms 130 and 132 connected with the rods 122 and 124. The central clip 128 is formed to be secured to the roller shaft 12 and includes a flattened inner section 128*a* integrally connected with arms 130 and 132 and having a semi-cylindrical central section conforming in shape to the roller shaft 12. The central clip 128 also has a removable flattened outer section 128*b* complementary in shape to the inner section 128*a*. The inner and outer sections 128*a* and *b* are mated together to fit onto roller shaft 12 and are secured together by machine screws 134 extending through aligned openings in the sections. Loosening the screws 134 will permit selective rotation of the shield assembly to orient the shield as discussed about the paint roller.

Various other forms of clips may be used in securing the shield assembly to the paint roller. For example, spring clips of different designs could be used to secure the shield assembly to the roller shaft as well as to the handle portion. Similarly various designs are available for locking or securing the shield assembly to the roller shaft or the handle portion of the roller assembly.

The shields of the respective embodiments of the present invention have been described as having semi-cylindrical shapes. It is to be noted that the term "semi-cylindrical" includes any trough-like shape be it rectangular, frustro, or the like in cross section.

It should now be clearly understood how the advantages of the present invention as specified in the introductory portion of this specification are achieved.

While I have shown and described certain embodiments of this invention, it is to be distinctly understood that the invention is not limited thereto, but may be otherwise variously embodied within the scope of the following claims.

I claim:

1. In combination, a paint roller having a shaft and a handle member rigidly extending radially from one end thereof; and a splash shield assembly comprising support means having a plurality of shield receiving members extending generally longitudinally of and parallel with the axis of the shaft;

connecting means for securing said support means in fixed relationship with the shaft;

a semi-cylindical shield member shaped and sized to extend over a substantial length and periphery of the paint roller and removably received on said shield receiving members; and said connecting means constructed and arranged for selective rotation about the shaft generally coaxially with the roller axis whereby said shield member may be positioned on either side of the roller.

2. The combination as set forth in claim 1 wherein said shield receiving members of said support means are a pair of generally parallel elongated rod members extending generally coextensively of the axis of the shaft; and said shield member has its side sections shaped to be removably received on said rod members.

3. The combination as set forth in claim 1 wherein said shield receiving members of said support means are a plurality of tab members disposed alternately one above the other in a generally semi-cylindrical pattern whereby one end of said shield member is removably supported by the tab members.

4. The combination as set forth in claim 1 including securing means for removably locking said connecting means to the handle member.

5. The combination as set forth in claim 1 wherein said connecting means includes a stub-shaft member generally coaxially with the roller shaft and a lock member removably received on said stub-shaft.

6. The combination as set forth in claim 1 wherein said connecting means includes a clip member removably received on the handle member adjacent the roller shaft, a stub-shaft member secured to said clip and arranged thereon to be generally coaxial with the roller shaft, and a lock member removably received on said stub-shaft.

7. The combination as set forth in claim 1 wherein said support means and said connecting means are formed from a single piece of rod; and wherein said connecting means is a section of said rod defining a generally cylindrical hub sized to snugly fit on the shaft.

8. The combination as set forth in claim 1 wherein said connecting means includes a clip member removably received on the shaft.

9. A splash shield assembly for a paint roller having a shaft and a radial handle member rigidly extending generally perpendicularly to the shaft from one end thereof, comprising support means having a plurality of longigudinally extending generally parallel shield receiving members; connecting means including a hub section connected with the shield receiving members for removably securing said support means to the paint roller such that said hub section is generally coaxial with the shaft of the paint roller and the receiving members generally parallel with the shaft, said hub section constructed to be selectively rotated about the axis of of shaft of the paint roller; and a semi-cylindrical shield member shaped and sized to extend over a substantial length and periphery of the paint roller and removably received on said shield receiving membes.

10. A splash shield assembly as set forth in claim 9 including securing means for locking said support means in fixed relationship to the shaft.

11. A splash shield assembly as set forth in claim 9 wherein said shield receiving members of said support means are a pair of generally parallel elongated rod members; and said shield member has its side sections shaped to be removably received on said rod members.

12. A splash shield assembly as set forth in claim 9 wherein said shield receiving members of said support means are a plurality of tab members disposed alternately one above the other in a generally semi-cylindrical pattern whereby one end of said shield member is removably supported by the tab members.

13. A splash shield assembly as set forth in claim 9 wherein said connecting means includes a clip sized and shaped to be removably received on the handle member adjacent the paint roller shaft.

14. A splash shield assembly as set forth in claim 9 wherein said support means and said connecting means are formed from a single piece of rod; and wherein said connecting means is a section of rod defining a generally cylindrical hub section shaped and sized to be received on the shaft of the paint roller.

15. A splash shield assembly as set forth in claim 9 wherein said connecting means includes a clip member removably received on the shaft of the paint roller.

16. A splash shield assembly as set forth in claim 9 wherein said connecting means includes a clip constructed to be removably received on the handle member of the paint roller said clip having a stub-shaft at a position to be generally co-axial with the shaft of the paint roller when the clip is secured to the handle member, said stub-shaft constructed to rotatably receive said hub section.

* * * * *